United States Patent [19]

Rowley

[11] Patent Number: 4,942,644

[45] Date of Patent: Jul. 24, 1990

[54] STRAP HANGER

[76] Inventor: William W. Rowley, 11524 Wilbert Rd., Chardon, Ohio 44024

[21] Appl. No.: 713,331

[22] Filed: Mar. 18, 1985

[51] Int. Cl.[5] ..... B65D 63/00

[52] U.S. Cl. ..... 24/16 PB; 24/30.5 P

[58] Field of Search ..... 24/16 PB, 30.5 P, 16 R, 24/30.5 R

[56] References Cited

U.S. PATENT DOCUMENTS

| | | | |
|---|---|---|---|
| 1,282,468 | 10/1918 | Scheel | 24/16 PB |
| 2,870,501 | 1/1959 | Combs | 24/16 PB |
| 2,977,145 | 3/1961 | Rifkin | 24/16 PB |
| 3,072,986 | 1/1963 | Lefnaer | 24/16 PB |
| 3,130,462 | 4/1964 | Mitchell | 24/16 PB |
| 3,197,308 | 8/1965 | Hoadley | 24/16 PB |
| 3,238,580 | 3/1966 | Arai | 24/16 PB |
| 3,702,349 | 9/1887 | Brombacher | 24/16 PB |
| 3,973,610 | 8/1976 | Ballin | 24/16 PB X |

FOREIGN PATENT DOCUMENTS

| | | | |
|---|---|---|---|
| 556449 | 4/1923 | France | 24/16 PB |
| 1358338 | 3/1964 | France | 24/16 PB |
| 346341 | 3/1931 | United Kingdom | 24/16 PB |
| 1123931 | 8/1968 | United Kingdom | 24/16 PB |

*Primary Examiner*—Laurie K. Cranmer

*Attorney, Agent, or Firm*—Renner, Otto, Boisselle & Sklar

[57] ABSTRACT

This device relates to an adjustable hanger strap for use in the bundling and securing of various articles such as coils of wire, rope, hose, one or more pieces of tubing or rod, hand tools and equipment, and more specifically the mooring or temporary power feed lines utilized on a boat. The invention is constructed of a flexible material such as leather or plastic and one end of the strap includes an arrowhead shaped portion which upon looping and forming a noose, may be inserted through one or more locking holes located in the body of the strap and subsequently locked without deforming or bending the arrowhead shaped portion or the edges of the holes. The opposite end of the strap may also include an arrowhead for use as described or it may be adapted for attachment to extraneous devices or objects.

6 Claims, 1 Drawing Sheet

STRAP HANGER

This invention relates as indicated to a strap hanger and more particularly to a strap hanger adapted readily to be formed into one or more loops of various size.

BACKGROUND OF THE INVENTION

Various types of straps for use as locking or closure devices such as bag ties have been available for some time and have been extensively used. In this connection reference is made to the structures disclosed in the Edwin F. Toepfer U.S. Pat. No. 2,961,785, the William J. Clayton U.S. Pat. No. 3,874,034 and the Thoon Goo Rhee U.S. Pat. No. 3,913,179. Some prior art closures are objectionable in that they are not suited as a hanger device or they employ metallic hasps, clamps, buckles or the like which may scratch or rust adjacent structures or devices. Additionally, when the thickness of the material with which the strap is constructed is increased, correspondingly reducing the flexibility of the strap, the operation of many of prior art straps is hampered or even made impossible.

SUMMARY OF THE INVENTION

In the present invention an improved adjustable hanger strap is provided for the bundling and securing of various articles such as coils of wire, rope, hose, one or more rods or tubes, hand tools and equipment, and more specifically mooring or temporary power lines utilized on a boat. All forms of the strap are employed by bending the strap upon itself to form a loop or noose, twisting the strap one-quarter turn to allow the insertion of the end into one or more of the locking holes located in the body of the strap, and reverse twisting the strap to facilitate the locking of the end against the edges of the hole.

The strap may be produced from a variety of flexible materials such as leather or plastic by various techniques known to those skilled in the art but is best produced by a high density polyethylene in widths of approximately one to two inches via an extrusion process.

The strap has primarily two distinct embodiments from which various modified forms may stem. In the first basic embodiment, the strap includes arrowhead portions at each of its ends and at least one I-shape hole located along the length and between the lateral edges of the strap. The I-shape hole is adapted to permit the insertion, rotation and locking of the arrowhead portion and the reverse thereof. The arrowhead portion includes a narrow or notched portion the width of which is approximately one-half the width of the body of the strap, a rectangular portion, and a truncated V-shaped tip portion. The rectangular portion which, is the width of the body of the strap, is located between the narrow or notched portion and the V-shaped portion, forming locking shoulders at the edges of the notch closest to the tip.

In the second basic embodiment the strap includes the aforementioned arrow-shaped portion at only one of its ends, the opposite end of the strap being adapted for various uses such as the attachment to hooking, hanging or securing devices, direct attachment to an extraneous object, or simply the holding of the strap in one's hand. Such adaptations manifest themselves in various forms, a few of such forms being a circular, square or pointed end, or a rounded end with a centrally located circular hole. Additionally, this embodiment includes at least one Y-shape locking hole adapted to facilitate the insertion, rotation, and locking of the arrowhead portion and the reverse thereof.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE PREFERRED EMBODIMENTS

Figure 1:
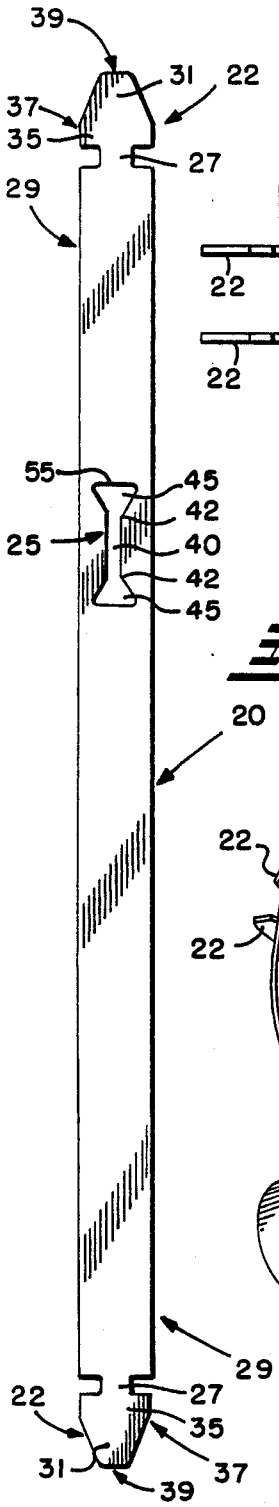
FIG. 1 is a plan view of the strap with arrowhead portions at each end.

Referring in detail to the drawings and initially to FIG. 1, an embodiment of the adjustable hanger strap 20 made in accordance with the present invention is shown. This embodiment of the strap includes arrowhead shaped portions 22 at each of its opposite ends and at least one I-shape locking hole 25 intermediate its ends adapted for the insertion and locking of the arrowheads 22. The arrowheads 22 include a narrow or notched portion 27 the width of which is approximately one-half the width of the body 29 of the strap 20, a rectangular portion 35 the width of which is that of the body 29, and a V-shape portion 31. At 37 the wide end of the V-shape portion 31 tapers to a flat tip 39 the width of which is approximately one-third the width of the body 29.

The I-shape locking hole 25 includes a longitudinal slot 40 the opposite ends of which flare open at 42 forming symmetrical triangular enlargements 45, the edges of which are normal to said longitudinal slot 40. The width of said longitudinal slot 40 is approximately twice the thickness indicated at 56 of the strap 20. The width of the enlargement 45 is slightly more than one-half the width of the body.

Figure 3:
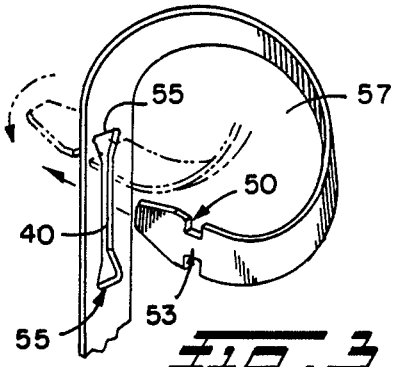
FIG. 3 is a fragmentary isometric view of the strap detailing the method of inserting and locking the arrowhead.

As shown in FIG. 3 the arrowhead 22 is inserted and locked into the I-shape locking hole 25 by first forming a loop and then twisting the body 90°. Upon twisting, the arrowhead 22 may be easily inserted through the longitudinal slot 40 until the notched portion 28 is aligned with the longitudinal slot 40 and then moved to either of the triangular enlargements 45. The body 29 is then twisted 90° back to its original position with the shoulder edges 50 of the notches at the rectangular portion 35 engaging behind the triangular enlargement 45 of the I-shape locking hole 25. The face 53 of the strap at the notched portion 27 engages the end 55 of the locking hole 25.

Figure 2:
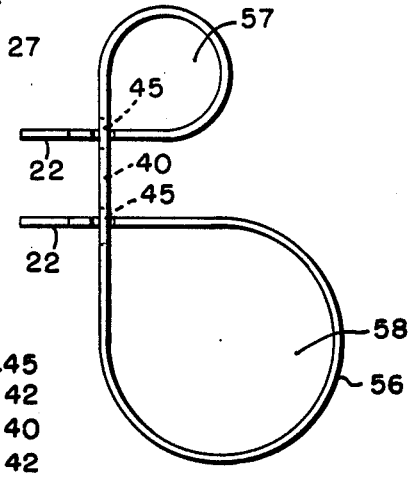
FIG. 2 is a side view of the strap with both ends looped through the same side of the strap and locked.

Although it is normally desired to make the loop 57 thus formed as tight as possible by twisting the arrowhead 22 at the end of the locking hole 25 in the direction of the arrowhead, it will be appreciated that the arrowhead may be twisted at the opposite end of the locking hole 25 somewhat to enlarge the loop. The dimensions of the triangular enlargement 45 and the notched portion 27 are such as to permit the twisting of the strap with minimal distortion. Because of the flexibility of the preferred polyethylene material the arrowheads 22 at both ends of the strap may be locked in a common end of the locking hole 25. As seen in FIG. 2, depending on the location of the locking hole, two loops 57 and 58 of the two different sizes may readily be formed.

Figure 4:
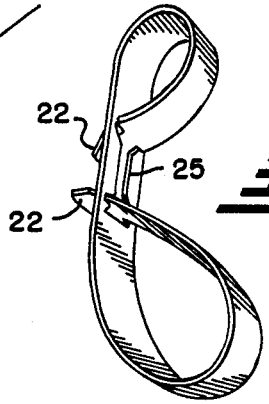
FIG. 4 is a similar view of the strap with both ends looped through the same side of the strap and locked.
Figure 5:
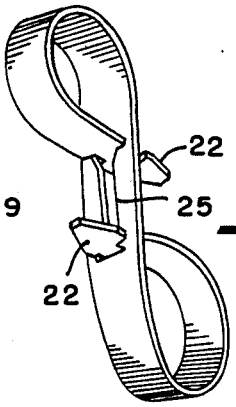
FIG. 5 is a similar view of the strap with each end looped through opposite sides of the strap and locked.

As shown in FIG. 4, the arrowheads 22 at each end of the strap 20 may be looped around and inserted through the locking hole 25 from the same direction or if desired as shown in FIG. 5 from opposite directions. The form of FIG. 5 might be used, for example, to secure a bundle of power or mooring lines to the outside of a ships railing.

Figure 6:
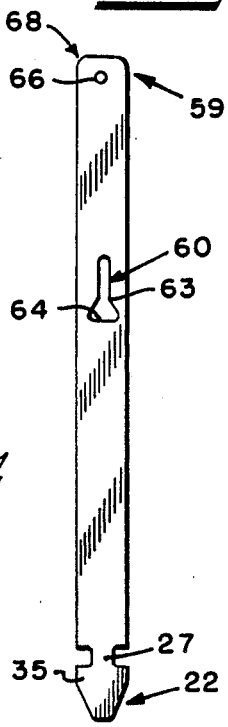
FIG. 6 is a plan view of another embodiment with an arrowhead portion at one end and rounded edges and a circular hole at the opposite end; and, FIG. 7 is a similar view of still another form of the strap with multiple Y-shape locking holes and the reinforcement of the edges.

In FIG. 6, another embodiment of the present invention is shown wherein only one end of the strap 20 includes an arrowhead 22, the opposite end 59 being adapted for securing to extraneous objects. This embodiment includes at least one Y-shape locking hole intermediate the ends of the strap adapted for insertion and locking of the arrowhead 22. The Y-shape hole 60 includes a longitudinal slot 62 which flares at one end at 63 and forms symmetrical triangular enlargement 64, the end edge of which is normal to slot 62. The width of said longitudinal slot 62 is approximately twice the thickness 56 of the strap 20. The adapted end 59 includes rounded corners 68 and a centrally located circular hole 66 which allows the strap to be readily suspended from a nail, screw, spike or the like.

Figure 7:
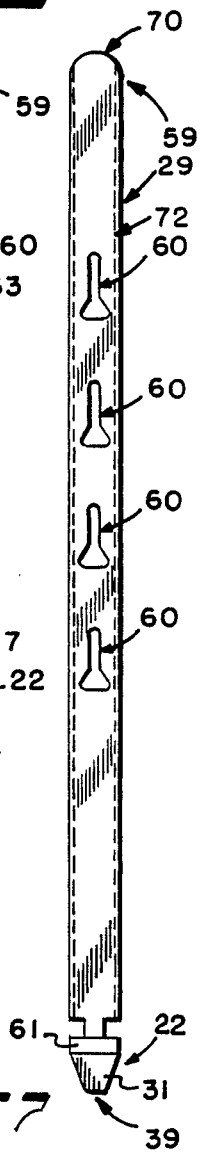

In FIG. 7, yet another embodiment of the invention is shown wherein the adapted end 59 includes a semi-circular end and the body of the strap 29 includes multiple Y-shape holes 60 and edge reinforcement 72. The reinforcement 72, which is preferably formed in the strap during the extrusion process may comprise one or more strands of materials such as a steel, nylon, or fiberglass. Additionally the arrowhead 22 may include a transverse metal reinforcing member 61 that when securely attached to the rectangular portion 35 will result in a significant improvement in the tensile strength of the strap. The strap may be readily attached to an extraneous object such as a wooden dock or support by hammering a nail through the adapted end 59 and into the wooden dock.

It will be appreciated that the strap is well suited for use as a hanger. The design of the strap is such that it may be employed quickly and easily, requiring minimal dexterity. While looping, inserting and locking the strap deformation and bending is confined to the body of the strap thus allowing the strap to be constructed of a heavier less flexible material.

Although the strap of the present invention may vary somewhat in dimension, as an example, the strap of FIG. 7 is approximately thirty inches long, $1\frac{1}{4}$ inches wide and between 1/32 and 1/16 of an inche in width.

It will be appreciated that when the strap is constructed of a relatively soft yet flexible material such as polyethylene or leather, it will not scratch or abrade adjacent fixtures or objects. Thus, this invention is suitable for use as a hanger in conjunction with an automobile, boat or any other object which is susceptible to marking or scratching.

I claim:

1. A flexible hanger strap comprising a strip of bendable material having at least one locking hole positioned centrally between the lateral edges of said strap, said hole comprising a longitudinal slot which flares open at each of its ends forming a pair of triangular enlargements the end edges of which are approximately one-half the width of said strap and normal to said longitudinal slot, both ends of said strap having an arrowhead each of which may be respectively inserted and locked into said hole forming double loops with no undue deformation or bending of the edges of said hole or said arrowheads, said arrowheads each having a width approximately equal to the width of the strap and a notched portion being slightly smaller than the width of the triangular enlargements whereby when said loops are formed and said arrowheads are inserted through said hole and said notched portions are aligned respectively within each of said triangular enlargements the shoulder edges of said notched portions engage behind said triangular enlargements with the surface of said strap at said notched portions engaging the ends of said triangular enlargements.

2. The strap of claim 1 wherein said strip of bendable material comprises a thermoplastic material.

3. The strap of claim 1 wherein said strip of bendable material comprises a high density polyethylene.

4. The strap of claim 1 wherein said strip of bendable material comprises leather.

5. The strap of claim 1 wherein at least one of said lateral edges of said strap includes a stranded reinforcing material.

6. The strap of claim 1 including more than one locking hole to form loops of different sizes.

* * * * *